US008836540B2

(12) United States Patent
Wang et al.

(10) Patent No.: US 8,836,540 B2
(45) Date of Patent: Sep. 16, 2014

(54) STREETLIGHT SYSTEM AND METHOD FOR ESCAPING FROM DISASTER USING THE SAME

(71) Applicants: GDS Software (ShenZhen) Co., Ltd., Shenzhen (CN); Hon Hai Precision Industry Co., Ltd., New Taipei (TW)

(72) Inventors: Chi-Chih Wang, New Taipei (TW); Tzu-Te Wang, New Taipei (TW); Bo Ming, Shenzhen (CN)

(73) Assignees: GDS Software (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/705,196

(22) Filed: Dec. 5, 2012

(65) Prior Publication Data

US 2013/0234865 A1 Sep. 12, 2013

(30) Foreign Application Priority Data

Mar. 6, 2012 (CN) ..... 2012 1 0055985

(51) Int. Cl.
*G08G 1/095* (2006.01)
*G08B 21/10* (2006.01)

(52) U.S. Cl.
USPC ..... 340/944; 340/539.1; 340/332; 455/404.1

(58) Field of Classification Search
CPC ..... G08B 21/00; G08B 21/02; G08B 25/009; G08B 27/00; G08B 27/008; G08B 21/10
USPC ..... 340/539.1, 944, 500, 332; 455/404.1
See application file for complete search history.

(56) References Cited

U.S. PATENT DOCUMENTS

| | | | | |
|---|---|---|---|---|
| 5,815,068 | A * | 9/1998 | Vadseth | 340/332 |
| 7,597,455 | B2 * | 10/2009 | Smith et al. | 362/249.01 |
| 8,102,251 | B2 * | 1/2012 | Webb | 340/539.1 |
| 8,456,325 | B1 * | 6/2013 | Sikora | 340/909 |
| 8,570,190 | B2 * | 10/2013 | Marinakis et al. | 340/915 |
| 8,593,299 | B2 * | 11/2013 | Pederson | 340/815.45 |
| 2006/0058004 | A1 * | 3/2006 | Dolezal et al. | 455/404.1 |
| 2007/0252688 | A1 * | 11/2007 | Eisold et al. | 340/506 |
| 2009/0305659 | A1 * | 12/2009 | Hochendoner et al. | 455/404.1 |
| 2009/0305660 | A1 * | 12/2009 | Liu | 455/404.1 |
| 2011/0215735 | A1 * | 9/2011 | Herbst et al. | 315/297 |
| 2012/0119679 | A1 * | 5/2012 | Riesebosch | 315/313 |
| 2012/0194352 | A1 * | 8/2012 | Ellis et al. | 340/907 |

* cited by examiner

*Primary Examiner* — Eric M Blount
(74) *Attorney, Agent, or Firm* — Novak Druce Connolly Bove + Quigg LLP

(57) ABSTRACT

A streetlight system includes a plurality of streetlights, disaster warning systems positioned at each of the streetlights and a control center electrically connected with the disaster warning systems. The streetlights are positioned at roadways. Each of the disaster warning systems includes a control system and a broadcasting system. When the control center receives a disaster alert signal, the control center transmits information of disaster shelters and evacuating routes to control system, and the broadcasting system broadcasts information of the disaster shelters and the evacuating routes to people for leading people to escape.

12 Claims, 5 Drawing Sheets

STREETLIGHT SYSTEM AND METHOD FOR ESCAPING FROM DISASTER USING THE SAME

BACKGROUND

1. Technical Field

The disclosure generally relates to a streetlight system and a method for escaping from a disaster using the streetlight system.

2. Description of Related Art

Disasters, such as earthquake or tsunami, will bring a great hazard to people's life and health. When a disaster is happened, people may have difficulty to react quickly to the situation. Without an effective disaster alert system, it is impossible for people to know where a disaster shelter is and how to get to the disaster shelter in time.

What is needed, therefore, is a streetlight system and a method for escaping from in a disaster using the streetlight disaster which can overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
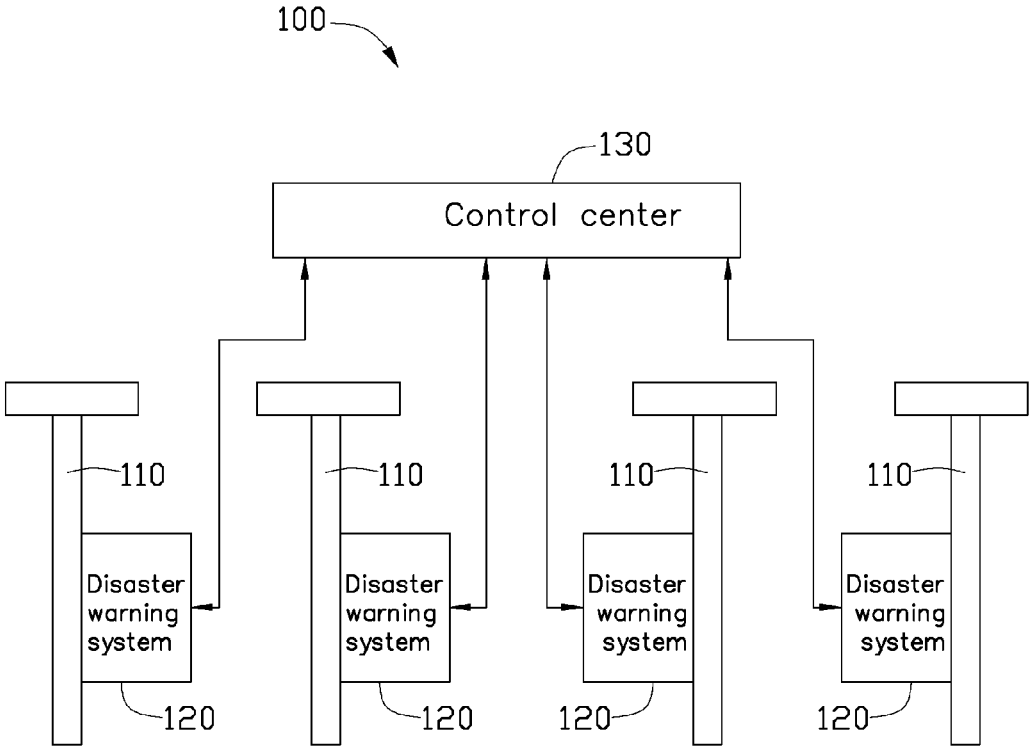
FIG. 1 is a schematic view of a streetlight system in accordance with one embodiment of the disclosure.

Referring to FIG. 1, a streetlight system 100 in accordance with one embodiment of the disclosure is shown. The streetlight system 100 includes a plurality of streetlights 110 located beside a roadway, a plurality of disaster warning systems 120 and a control center 130.

Figure 2:
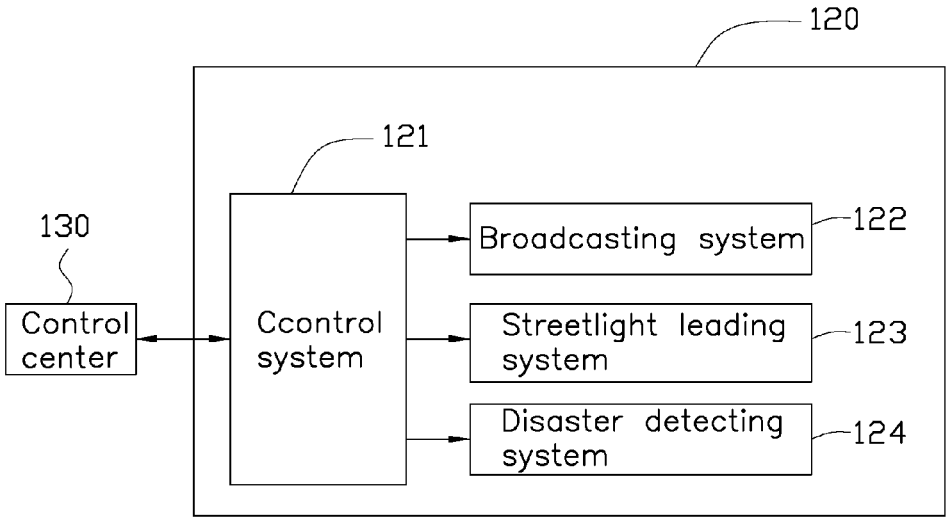
FIG. 2 is a schematic view showing a disaster warning system of FIG. 1.
Figure 3:
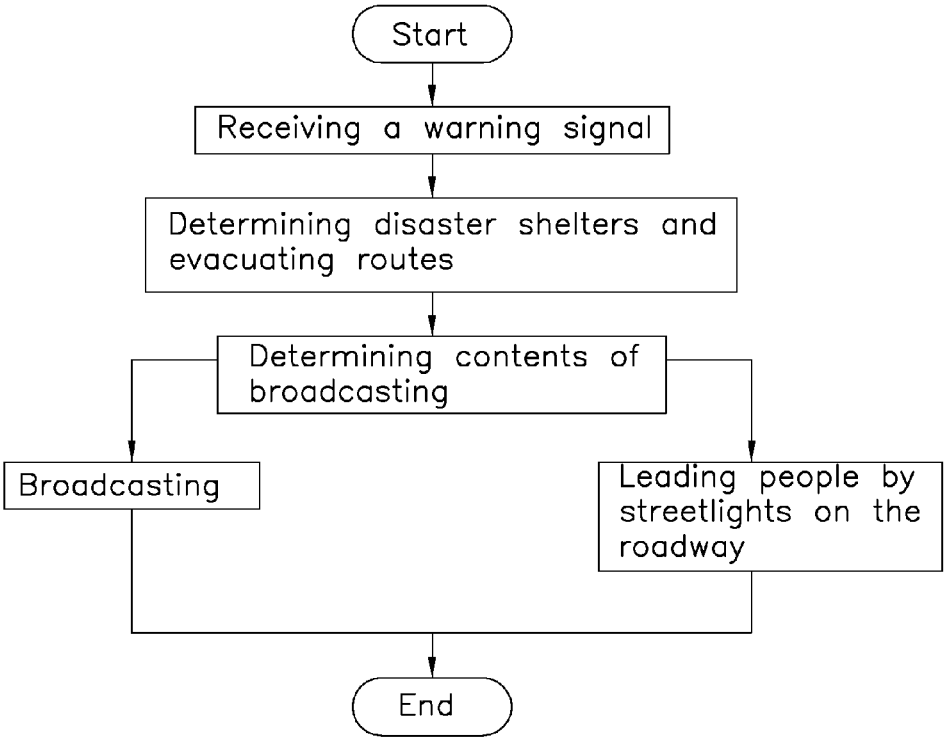
FIG. 3 is a flow chart showing an operation of the streetlight system of FIG. 1.

The disaster warning systems 120 are positioned at each of the streetlights 110 respectively. In this embodiment, the disaster warning system 120 is secured to a lamp pole of the streetlight 110. Referring also to FIG. 2, each of the disaster warning systems 120 includes a control system 121, a broadcasting system 122 and a streetlight leading system 123 connected with the control system 121. The broadcasting system 122 is configured to broadcast information of a disaster to the people. The streetlight leading system 123 is configured to indicate disaster shelters and evacuating routes to the people by turning on or turning off the streetlights along the evacuating routes. Referring to FIG. 3, when a disaster such as earthquake, fire and tsunami, happens, the control center 130 first receives a disaster alert signal from persons working in the control center 130 or from the disaster warning system 120. According to the disaster alert signal, the control center 130 can make sure when and where the disaster happens, where are the disaster shelters and the evacuating routes to get to the disaster shelters. After that, the control center 130 transmits the information of the disaster to the control system 121 for leading the people to escape. In this embodiment, there are mainly two ways for leading people to escape. One way is that the control system 121 broadcasts the disaster shelters and the evacuating routes to people by the broadcasting system 122. Another way is that the control system 121 sequentially turns on or turns off the streetlights 110 along the roadway to indicate the disaster shelters and the evacuating routes to people. Preferably, the two ways can also be applied to the streetlight system 100 at the same time.

The disaster warning system 120 can further includes a disaster detecting system 124. The disaster detecting system 124 can be a fire alert device, a smoke detecting device or a seismograph. When a disaster happens, the disaster detecting system 124 determines the happening of the disaster and transmits the information to the control system 121. After receiving the information from the disaster detecting system 124, the control system 121 can generate a disaster alert signal to the control center 130.

Figure 4:
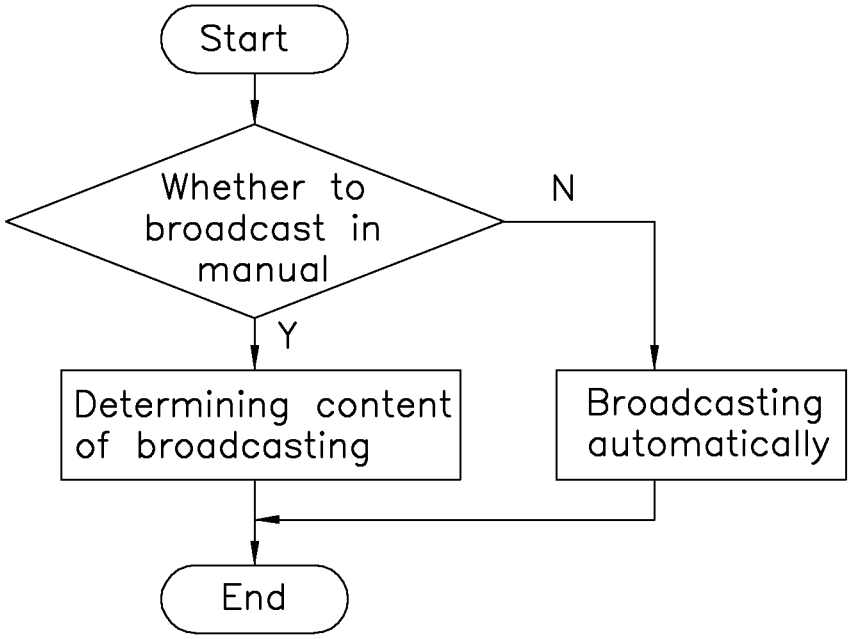
FIG. 4 is a flow chart showing an operation of a broadcasting system of FIG. 2.

The broadcasting system 120 includes a manual broadcasting system and an automatic broadcasting system. In the manual broadcasting system, the broadcasting of the information about the disaster is processed by persons working in the control center 130. In the automatic broadcasting system, a voice information is previously stored in the control system 121, and when a disaster happens, the control system 121 broadcasts the predetermined voice information to people need to escape. Referring to FIG. 4, in operation, the control system 121 first determines whether a manual broadcasting is needed. If the answer is "Yes", the control system 121 will broadcast the information of the disaster to people in manual. If the answer is "No", the control system 121 will broadcast the voice information previously stored in the control system to the people. For example, some kinds of disasters need to be broadcasted in manual, and other kinds of disasters need to be broadcasted automatically. In an alternative embodiment, the determination can be processed by a control switch. That is, the control system 121 determines whether to broadcast in manual by determining the position of the switch. Persons working in the control center 130 can change the position of the switch, thereby selecting one of the manual broadcasting system and the automatic broadcasting system.

Figure 5:
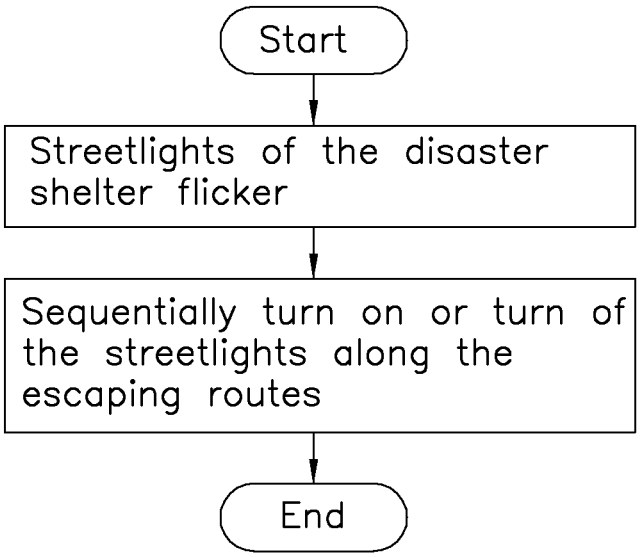
FIG. 5 is a flow chart showing an operation of the streetlight leading system of FIG. 2.

FIG. 5 shows a working process of the streetlight leading system 123. When the control center 130 transmits the information of the disaster shelters and the evacuating routes to the control system 121, the control system 121 will indicate the disaster shelter and the evacuating routes by turning on or turning off the streetlights 110 along the evacuating routes, thereby leading people to escape. In an alternative embodiment, the streetlights 110 in the disaster shelters flicker to indicate the location of the disaster shelters to the people.

In the streetlight system 100 described above, the disaster warning system 120 is positioned at the streetlights 110. After receiving a disaster alert signal, the control center 130 can immediately transmit the information of disaster, such as the disaster shelters and the evacuating routes, to the control system 121. Then, the control system 121 broadcasts the disaster shelters and the evacuating routes to people. At the same time, the streetlight leading system 123 can also turn on or turn off the streetlights along the evacuating routes, for leading people to escape from the disaster.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A streetlight system, comprising:

a plurality of streetlights located beside roadways;

a plurality of disaster warning systems positioned at each of the streetlights, respectively, each of the disaster warning systems comprising a control system and a broadcasting system; and a control center electrically connected with the disaster warning systems, wherein, when the control center receives a disaster alert signal, the control center transmits information of disaster shelters and evacuating routes to control system, and the broadcasting system broadcasts information of the disaster shelters and the evacuating routes to people for leading people to escape;

wherein the broadcasting system includes a manual broadcasting system and an automatic broadcasting system, the control system first determines whether a manual broadcasting is needed, if the answer is "Yes", the control system will broadcast the information of the disaster to people via manual broadcasting, if the answer is "No", the control system will broadcast the voice information previously stored in the control system to the people.

2. The streetlight system of claim 1, wherein the information of the disaster shelters and the evacuating routes of the manual broadcasting system is broadcasted by persons working in the control center.

3. The streetlight system of claim 1, wherein a voice information of the automatic broadcasting system is previously stored in the control system, when a disaster happens, the broadcasting system broadcasts the voice information stored in the control system.

4. The streetlight system of claim 1, wherein the disaster warning system further comprises a streetlight leading system electrically connected with the control system, the streetlight leading system sequentially turns on or turns off the streetlights along the evacuating routes to indicate the evacuating routes to people.

5. The streetlight system of claim 4, wherein the streetlight leading system further controls the streetlights in the disaster shelters to flicker to illustrate locations of the disaster shelters to people.

6. The streetlight system of claim 1, wherein the disaster warning system further comprises a disaster detecting system, the disaster detecting system detects the happening of a disaster and transmits the information of the disaster to the control center through the control system.

7. A method for escaping from a disaster using a streetlight system, comprising following steps:

providing a streetlight system, having a plurality of streetlights located beside roadways;

positioning a plurality of disaster warning systems at each of the streetlights, each of the disaster warning systems comprising a control system and a broadcasting system, wherein, the broadcasting system includes a manual broadcasting system and an automatic broadcasting system, the control system first determines whether a manual broadcasting is needed, if the answer is "Yes", the control system will broadcast the information of the disaster to people in manual, if the answer is "No", the control system will broadcast the voice information previously stored in the control system to the people; and providing a control center electrically connected with the disaster warning systems, wherein, when the control center receives a disaster alert signal, the control center transmits information of disaster shelters and evacuating routes to control system, and the broadcasting system broadcasts information of the disaster shelters and the evacuating routes to people for leading people to escape.

8. The method of claim 7, wherein the information of the disaster shelters and the evacuating routes of the manual broadcasting system is broadcasted by persons working in the control center.

9. The method of claim 7, wherein a voice information of the automatic broadcasting system is previously stored in the control system, when a disaster happens, the broadcasting system broadcasts the voice information stored in the control system.

10. The method of claim 7, wherein the disaster warning system further comprises a streetlight leading system electrically connected with the control system, the streetlight leading system sequentially turns on or turns off the streetlights along the evacuating routes to indicate the evacuating routes to people.

11. The method of claim 10, wherein the streetlight leading system further controls the streetlights in the disaster shelters to flicker to illustrate locations of the disaster shelters to people.

12. The streetlight system of claim 7, wherein the disaster warning system further comprises a disaster detecting system, the disaster detecting system detects the happening of a disaster and transmits the information of the disaster to the control center through the control system.

* * * * *